United States Patent [19]

Damaso et al.

[11] Patent Number: 4,751,009

[45] Date of Patent: Jun. 14, 1988

[54] FABRIC SOFTENERS COMPRISING STABLE SINGLE PHASE CLEAR SOLUTIONS OF ANIONIC AND CATIONIC SURFACTANTS

[75] Inventors: Gene R. Damaso, Northlake; Eugene R. Carr, Chicago, both of Ill.

[73] Assignee: Akzo America Inc., New York, N.Y.

[21] Appl. No.: 81,924

[22] Filed: Aug. 5, 1987

[51] Int. Cl.[4] ..... D06M 13/44

[52] U.S. Cl. ..... 252/8.75; 252/545; 252/547; 252/558

[58] Field of Search ..... 252/8.75, 545, 547, 252/558

[56] References Cited

U.S. PATENT DOCUMENTS

| | | | |
|---|---|---|---|
| 3,997,453 | 12/1976 | Wixon | 252/8.75 |
| 4,118,327 | 10/1978 | Seugnet | 252/8.8 |
| 4,338,204 | 7/1982 | Spadini | 252/8.75 |

FOREIGN PATENT DOCUMENTS 1070073 4/1986 Japan .

*Primary Examiner*—A. Lionel Clingman
*Assistant Examiner*—Isabelle Rodriguez
*Attorney, Agent, or Firm*—Louis A. Morris; Francis W. Young

[57] ABSTRACT

A fabric softener composition comprising a stable, clear single phase solution of an anionic surfactant having an alkyl radical containing at least eight carbon atoms, a cationic surfactant, water and an effective amount of propylene glycol and an alkali metal salt of benzene, toluene or xylene sulfonate. The fabric softener may be highly concentrated and has the property that when added to a detergent solution it imparts a fabric softening effect but does not lessen the detergency of the solution.

9 Claims, No Drawings

FABRIC SOFTENERS COMPRISING STABLE SINGLE PHASE CLEAR SOLUTIONS OF ANIONIC AND CATIONIC SURFACTANTS

BACKGROUND OF THE INVENTION

There has been a long felt desire of being able to introduce a liquid fabric softener directly into an aqueous solution of a laundry detergent. The advantages of such a mixture are obvious, the primary one being the simplification of the laundering task. A very difficult problem, however, is that the most effective detergents are anionic surfactants, the most effective fabric softeners are cationic surfactants and those two types of surfactants are not compatible in a common mixture.

Such incompatibility is due to both the cationic and anionic ingredients losing their respective surface active properties due to the interaction between the negatively charged hydrophilic group of the anionic surfactant and the positively charged hydrophilic group of the cationic surfactant. Such interaction generally results in the loss of the desirable surface active properties of each of the two types of surfactants. There are many examples in the art, however, with varying degrees of success, of attempts to form effective mixtures of anionic and cationic surfactants by the use of additional ingredients intended to minimize such loss of desirable properties.

U.S. Pat. No. 3,668,136 to Parker discloses an anionic and cationic surfactant mixture which was said to be compatible, without the need of ingredients, such as propylene glycols, by selection of a highly complex cation comprising a quaternary ammonium compound containing substituted groups such as alkoxy and piperidine groups. The aqueous solution shown in Parker having the highest concentration of Parker's composition is that of the shampoo of Example 5 which contains 15% of anionic surfactant, 8% of cationic surfactant and 73% water.

U.S. Pat. No. 3,703,480 to Grand et al discloses cationic softeners and anionic detergent mixtures with aminopolyureylene resin in dry particulate form until used in a highly diluted aqueous solution.

U.S. Pat. No. 3,997,453 to Wixon discloses cationic and anionic surfactant mixtures which may contain up to 5% anionic surfactant at least part of which may be sodium xylene sulfonate, and which is in the form of an opaque liquid.

U.S. Pat. No. 4,230,590 to Wixon discloses cationic softener and anionic detergent mixed with a fatty acid soap cellulose ether mixture to provide a dry shaped particle.

U.S. Pat. No. 4,255,294 to Rudy et al discloses a dry powdered mixture of a cationic nitrogenous compound and an anionic organic detergent as well as other ingredients, including sodium xylene sulfonate.

U.S. Pat. No. 4,272,395 to Wright discloses a cationic and anionic surfactant mixture including a short chain anionic surfactant which may comprise sodium xylene sulfonate and which may be in the form of a translucent liquid having up to 20% active detergent content.

U.S. Pat. No. 4,302,364 discloses a liquid detergent containing anionic and cationic surfactants and a nonionic ethoxylated component. The detergent may also contain a solvent such as one selected from the group consisting of lower aliphatic alcohols having from 1 to 6 carbon atoms and from 1 to 3 hydroxyl groups. The concentration of the cationic component in the detergent may be as high as 15%. The anionic surfactant may be an alkyl benzene sulfonate, but the alkyl group must contain from about 8 to about 15 carbon atoms.

U.S. Pat. No. 4,326,971 to Wixon discloses dry blended particles of a detergent composition comprising cationic, anionic and nonionic surfactants.

U.S. Pat. No. 4,507,219 to Hughes discloses liquid detergent compositions containing up to 15% anionic sulfonate which may be alkali metal salts of alkylbenzene sulfonates in which the alkyl group contains from about 10 to about 15 carbon atoms. Up to 5% of a cationic cosurfactant may also be present. Propylene glycol may be used with the detergent as part of a solvent system.

Japanese publication No. JP81055497 teaches that a cationic and anionic surfactant liquid detergent composition may be stable in the absence of additives such as propylene glycol and sodium benzene sulfonate and sodium p-toluene sulfonate. The Example shows 20 wt.% total of anionic surfactant and 2.7 wt. % of cationic surfactant. Over 70 wt. % of the detergent is water.

The present invention is based on the surprising discovery that it is possible to obtain a stable clear liquid solution which contains both anionic and cationic surfactants by adding to the solution an effective amount of propylene glycol and an alkali metal salt of benzene sulfonate, toluene sulfonate or xylene sulfonate. The mixture may then be employed as a fabric softener by adding it directly to an aqueous detergent solution. The detergent solution will thereby acquire a softening function without sacrifice of detergent strength.

SUMMARY OF THE INVENTION

The primary objective of the present invention is to obtain a highly concentrated stable, clear single phase liquid fabric softener which can be added to an aqueous detergent solution without comprising the effectiveness of the detergent.

Accordingly, the present invention, in its broadest embodiment, is a fabric softener composition comprising a stable clear single phase solution of from about 10 to about 16 wt % of an anionic surfactant having an alkyl radical containing at least eight carbon atoms, from about 20 to about 35 wt. % of a cationic surfactant, from about 15 to about 25 wt. % of propylene glycol, from about 8 to about 12 wt. % of an alkali metal salt of benzene sulfonate, toluene sulfonate or xylene sulfonate and a maximum of about 30 wt. % water.

Other embodiments encompass details about concentrations of the various components in the solution and the particular species of ingredients having utility in the invention.

DESCRIPTION OF THE INVENTION

A fabric softener composition comprising a stable, clear single phase solution which may be added directly to a detergent solution is of great commercial value, particularly if it may also be highly concentrated with regard to its softener components without lessening the strength of the detergent. Stability ensures that the fabric softener solution will not become opaque or separate into phases which would preclude consistency or homogeneity of dosages of the solution as poured from a container by a consumer. Clarity is desirable from the standpoint of aesthetics in that it conveys the impression of purity and generally makes for the most preferred appearance. High concentrations enable lower bulk and smaller containers in marketing as a fabric softener. Clarity of solution combined with the potential for high concentration thus provides a distinct advantage of the fabric softener of the present invention over prior art compositions.

The cationic surfactants most suitable as surfactants for the present invention are quaternary ammonium salts of the formula:

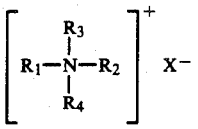

where $R_1$ is selected from the group comprising hydrocarbons containing from 8 to about 24 carbon atoms per molecule, $R_2$ is selected from the group comprising hydrocarbons containing from 1 to about 18 carbon atoms per molecule or the alcohols thereof, $R_3$ and $R_4$ are independently selected from the group comprising $—CH_3$ or $$—(CH_2\overset{\overset{\displaystyle CH_3}{|}}{C}H_2O)_nH$$

where n for both $R_3$ and $R_4$ totals from 2 to 50, and $X^-$ is any anion that forms a stable salt with the quaternary cation, preferably a halogen or methylsulfate. One group of such quaternary ammonium salts are the alkyltrimethylammonium chlorides, where $R_1$ of the above formula is the alkyl group, such as a tallow hydrocarbon.

The most preferred quaternary ammonium salt for use as the cationic surfactant in the process of the present invention is bis(2-hydroxypropyl)methyltallow alkylammonium chloride which is marketed under the trademark Propoquad® T/12 CL by Akzo Chemie America, 300 South Riverside Plaza, Chicago, Ill. 60606.

Suitable anionic surfactants have an alkyl radical containing at least eight carbon atoms, and the most suitable may be described as the water-soluble, ammonium or alkali metal or organic base salts of various fatty acids having about from 12 to 18 carbon atoms. Suitable anionic synthetics may be described as those detergents having pronounced cleansing power and including in their molecular structure an alkyl radical containing from eight to 18 carbon atoms and a sulfonic acid or sulfuric acid ester radical. Organic base, ammonium, sodium, or potassium salts of the anionic detergents may be used. The main types of detergents falling within this class are the alkylaryl sulfonates, such as sodium or potassium dodecylbenzene sulfonate, sodium or potassium octylnaphthalene sulfonate; alkyl sulfonates; the alkyl sulfates such as sodium or potassium salts of dodecyl, hexadecyl and octadecyl sulfates; the sulfonated fatty acid amines, such as sodium or potassium salts of the oleic acid amide of methyltaurine; and the sulfonated monoglycerides, such as the monococonut fatty acid ester of 1,2-hydroxypropane-3-sodium sulfonate. Of this class, linear alkyl groups are especially desirable because of their biodegradable features; and preferably they contain 12 to 14 carbon atoms in their alkyl group, such as dodecylbenzene sulfonate or tridecylbenzene sulfonate. The softener composition may contain, in addition, any of the usual optional ingredients such as dyes, perfumes, brighteners, and other optional additives. Any normally used laundry aids such as bleach, chlorine, oxygen, and water softeners may also be employed.

The remaining two essential ingredients are propylene glycol and a sulfonate of benzene, toluene or xylene. Although those ingredients are known by the prior art to be individually present in detergent solutions, their simultaneous presence is nowhere taught. We have made the surprising discovery that the particular mixture of propylene glycol and one of the aforementioned aromatic sulfonates has an apparently unique ability to stabilize cationic and anionic surfactant mixtures and enable clear solutions of high concentration.

Although not critical, we envision the effective concentration ranges of the detergent of our invention to be from about 10 to about 16 wt. % for the anionic surfactant, from about 20 to about 35 wt. % for the cationic surfactant, from about 15 to about 25 wt. % for the propylene glycol, from about 8 to about 12 wt. % for the alkali metal salt of the benzene sulfonate, toluene sulfonate or xylene sulfonate and about 30 wt. % maximum for water.

The following non-limiting examples illustrate the criticality of an alkali metal aromatic sulfonate and propylene glycol mixture in establishing a clear stable solution of cationic and anionic surfactants and the effectiveness of the fabric softener of the present invention in its intended use in a laundry solution.

EXAMPLE 1

In this example various blends of anionic and cationic surfactants were prepared with various combinations of stabilizers in order to observe which formed stable clear solutions. Each blend was prepared by blending its ingredients in a beaker with a magnetic stirrer, allowing the blend to sit for ten minutes and then subjecting the blend to a freeze-thaw cycle. The results of this example are tabulated in Table 1.

TABLE I

| | Cationic Anionic Surfactant Blends | | | | | | | | |
|---|---|---|---|---|---|---|---|---|---|
| | Examples in % by weight | | | | | | | | |
| Component | A | B | C | D | E | F | G | H | I |
| Water | | | | | | | | | |
| Anionic Surfactant | 27.94 | 27.94 | 27.94 | 27.94 | 27.95 | 31.68 | 27.94 | 34.60 | 39.96 |
| Branched Sodium Dodecylbenzene sulfonate (DDBS) | | | | | | | | | |
| Linear Sodium Dodecylbenzene sulfonate | 13.83 | 13.83 | 23.06 | 13.83 | 15.45 | 15.69 | 13.83 | | |
| Cationic Surfactant | | | | | | | | | |
| bis(2-hydroxypropyl)-methyltallow) alkyl- | | 29.01 | 29.01 | 29.01 | | 32.89 | 29.01 | 29.01 | 26.05 |

TABLE I-continued

| Component | Cationic Anionic Surfactant Blends Examples in % by weight A | B | C | D | E | F | G | H | I |
|---|---|---|---|---|---|---|---|---|---|
| ammonium chloride Methyl-sulfate of above | 27.89 | | | | 29.1 | | | | |
| Stabilizer | | | | | | | | | |
| Isoproanol | | | | | 9.63 | | | | |
| Propylene Glycol | 21.11 | 19.99 | 19.99 | 8.18 | | 9.28 | 19.99 | 13.33 | 7.35 |
| Diethylene Glycol | | | | 11.81 | 10.27 | | | | |
| Sodium Xylene Sulfonate | 9.23 | 9.23 | | 9.23 | 7.6 | 10.46 | 9.23 | 23.06 | 26.64 |
| Results | One phase liquid no precipitate | One phase liquid no precipitate | Gelled at room temp. | Was clear at room temp. but became hazy and unstable at freeze/thaw cycles | Cloudy at room temp. | Two phase liquid no precipitate | One phase liquid | One phase liquid | One phase |

It can be seen from Table 1 that of all the blends formulated which contained cationic and anionic surfactants, only blends having the ingredients and required concentrations of the present invention (blends A, B and G) were stable clear solutions.

EXAMPLE 2

In this example laundry studies were performed to illustrate that the fabric softener of the present invention can be added to the wash cycle of the laundering process and not be detrimental to detergency.

Tests were run using a standard laundry test consisting of a terg-o-tometer (basically a washing machine with only a wash cyle) set at a constant speed and temperature and used to wash cloth swatches. The softening evaluation comprises feeling the swatches after washing them in the test detergent system.

The detailed test procedure was as follows:

1. 4.5×3.5 inch swatches of 65/35 dacron/cotton blends were cut. These swatches had been previously soiled with standard soil as specified by U.S. Testing.
2. A Hunter reflectometer was standardized and readings of swatches before washings were recorded.
3. 1000 ml of deionized water were added to the terg-o-tometer's beaker for each test.
4. The temperature of the water bath in the test beaker was set at 35° C.
5. The appropriate amount of detergent was added to the beaker for each test.
6. The soiled test swatches were placed in the beaker for each test.
7. The terg-o-tometer was set for 10 minute cycle, speed at 125 rpms and temperature at 35° C.
8. After the cycle was complete, the swatches were rinsed twice in tap water.
9. The swatches were dried and new Hunter Reflectometer readings were recorded for those swatches.

Two tests were run for each of three wash water compositions. The first composition was plain water. The second composition was one-half cup of Dynamo brand liquid detergent per washload. The third composition was identical to the second except that one-quarter cup of the fabric softener of the present invention was added. The composition of the softener was 13.83 wt. % linear sodium dodecylbenzene sulfonate, 29.01 wt. % bis(2-hydroxypropyl)methyltallow alkylammonium chloride, 19.99 wt. % propylene glycol, 9.23 wt. % sodium xylene sulfonate and 27.94 wt. % water.

The results of the tests are as follows:

TABLE II

| | | Before Washing | After Washing | Change | % Change |
|---|---|---|---|---|---|
| Control | (1) | 53.4 | 55.4 | 2 | 3.74 |
| No/Detergent | (2) | 53.5 | 53.5 | 2 | 3.74 |
| Dyanamo | (1) | 53.3 | 69.4 | 16.1 | 30.2 |
| No/Softener | (2) | 53.6 | 69.9 | 16.3 | 30.4 |
| Dynamo with | (1) | 53.5 | 68.6 | 15.1 | 28.23 |
| Softener of the Invention | (2) | 53.1 | 68.8 | 15.7 | 29.6 |

The numbers in Table II indicate the degree of reflectance as measured by a Hunter Reflectometer as well as the % change in degree of reflectance of the washed as compared to the unwashed swatches. The lighter the color of the cloth the more the light can be reflected from it. This in turn leads to higher reflectance readings. Swatches washed have a higher reflectance due to the removal of soil.

From Table II it can be readily observed that there is almost no sacrifice in detergency when adding the softening composition of the present invention to detergent and wash water. It was also observed that the swatch washed with the detergent and softener combination had a distinct softened feel to it which the individuals who ran the tests observed from experience as being attributable to the use of a fabric softener. These results indicate an immense advantage of the fabric softener of the present invention as compared to known fabric softeners that can be added to the wash only after the wash cycle. On the other hand, when compared to fabric softeners that can be added during the wash cycle, the softener of the present invention offers the pleasing asthetics of a clear solution and the convenience of a stable single phase and high softener concentration.

We claim:

1. A fabric softener composition comprising a stable clear single phase solution of from about 10 to about 16 wt % of an anionic surfactant having an alkyl radical containing at least eight carbon atoms, from about 20 to about 35 wt. % of a cationic surfactant, from about 15 to about 25 wt. % of propylene glycol, from about 8 to about 12 wt. % of an alkali metal salt of benzene sulfonate, toluene sulfonate or xylene sulfonate and a maximum of about 30 wt. % water.

2. The solution of claim 1 wherein said anionic surfactant comprises a water soluble salt selected from the group consisting of alkali metal, ammonium or organic base salts of a fatty acid having said alkyl radical.

3. The solution of claim 2 wherein said anionic surfactant comprises an alkyl sulfonate, an alkylaryl sulfonate, an alkyl sulfate, a sulfonated fatty acid amine or a sulfonated monoglyceride.

4. The solution of claim 3 wherein said anionic surfactant comprises linear sodium dodecylbenzene sulfonate.

5. The solution of claim 1 wherein said cationic surfactant comprises a quaternary ammonium salt containing an alkyl radical of at least eight carbon atoms.

6. The solution of claim 5 wherein said quaternary ammonium salt has the formula:

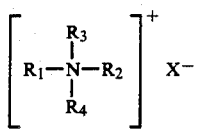

$R_1$ is selected from hydrocarbons containing from 8 to about 24 carbon atoms per molecule, $R_2$ is selected from the group comprising hydrocarbons containing from 1 to about 18 carbon atoms per molecule or the alcohols thereof, $R_3$ and $R_4$ are independently selected from the group comprising $—CH_3$ or

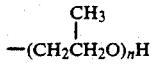

where n for both $R_3$ and $R_4$ totals from 2 to 50, and $X^-$ is any anion that forms a stable salt with the quaternary cation.

7. The solution of claim 6 wherein said quaternary ammonium salt comprises bis(2-hydroxypropyl)methyltallow alkylammonium chloride.

8. A fabric softener comprising a stable clear liquid solution containing from about 10 to about 16 weight% of an alkyl sulfonate anion having an alkyl radical containing at least eight carbon atoms, from about 20 to about 35 weight% of a quaternary ammonium salt cation having an alkyl radical containing at least eight carbon atoms, from about 15 to about 25 weight % of propylene glycol, from about 8 to about 12 weight % of sodium xylene sulfonate and about 30 weight% maximum of water.

9. The solution of claim 8 wherein said alkyl sulfonate comprises linear sodium dodecylbenzene-sulfonate and said quaternary ammonium salt comprises bis(2-hydroxypropylmethyltallow) alkylammonium chloride.

* * * * *